US005102384A

United States Patent [19]

Ross et al.

[11] Patent Number: 5,102,384

[45] Date of Patent: Apr. 7, 1992

[54] METHOD FOR MAKING FLAT BOTTOM PLASTIC BAG

[76] Inventors: Philip E. Ross, P.O. Box 21852, Ft. Lauderdale, Fla. 33335; Martin J. Brown, deceased, late of Pembroke Pines, Fla.; Maureen Hagenburg, heir; Letitia A. Brown, heir, both of 2501 Havana Dr., Miramar, Fla. 33023; Christine M. Weiss, heir, 9540 W. Elm La., Miramar, Fla. 33025

[21] Appl. No.: 401,773

[22] Filed: Sep. 1, 1989

[51] Int. Cl.[5] ..... B31B 33/26; B31B 33/00

[52] U.S. Cl. ..... 493/243; 493/256; 493/264; 493/936

[58] Field of Search ..... 493/243, 256, 257, 258, 493/259, 214, 936

[56] References Cited

U.S. PATENT DOCUMENTS

| | | | |
|---|---|---|---|
| 736,673 | 8/1903 | Bartholomew | 493/936 |
| 3,646,856 | 3/1972 | Worndl | 493/213 |
| 3,886,850 | 6/1975 | Cole | 493/243 |
| 3,896,709 | 7/1975 | Brinkmeier | 493/936 |
| 3,896,714 | 7/1975 | Bosse | 493/243 |
| 3,988,970 | 11/1976 | Hanson et al. | 493/936 |

FOREIGN PATENT DOCUMENTS

| | | | |
|---|---|---|---|
| 2131491 | 1/1972 | Fed. Rep. of Germany | 493/236 |

*Primary Examiner*—William E. Terrell
*Attorney, Agent, or Firm*—William E. Noonan

[57] ABSTRACT

A method is disclosed of constructing a flat bottom in a plastic film tube having an open upper end, a closed lower end formed by a transverse seal, forward and rearward sides and a pair of opposing pleated sides that interconnect the forward and rearward sides. The method includes the steps of releasably engaging a lower vacuum and a lower clamp with a transverse section of the rearward side of the tube to provisionally hold the transverse section. A lateral section of the forward side is gripped and raised by an upper vacuum and an upper clamp to expose a portion of the pleated sides such that first and second pockets are formed, respectively, in the sides. The sealed lower end is drawn toward the upper end to fold the tube along first and second transverse fold lines in the forward side, along a third transverse fold line in the transverse section of the rearward side, and along fourth and fifth fold lines, respectively, in the pleated sides such that the first and second pockets are located in the pleated sides, respectively between the first and third fold lines and the lower end of the bag. Pressure is applied to the tube to form creases along the first, third, fourth and fifth fold lines, which define the perimeter of the flat bottom of the tube.

4 Claims, 3 Drawing Sheets

METHOD FOR MAKING FLAT BOTTOM PLASTIC BAG

BACKGROUND OF THE INVENTION

This invention relates to a flat bottom plastic bag and to a method for constructing such a bag, and more particularly to a method for constructing a flat bottom in a plastic bag which has a laterally sealed bottom end and a pair of opposing pleated sides.

Flat bottom substantially free standing bags are widely utilized both in the grocery and fast food industries. Presently, however, most such bags are constructed from paper. As a result, they tend to tear rather easily. Moreover, spilled liquids and grease can leak through the paper and damage clothing, automobile upholstery or other items against which the bag rests. The paper bags are also heavier and occupy more storage space than comparable plastic bags. Thus, the cost of shipping and warehousing of paper bags is more expensive than for plastic.

Plastic bags provide improved strength and are largely leak resistant. But, in order for plastic bags to be considered as an alternative to paper bags, in most market areas they must have a flat bottom and must be folded to closely resemble the common paper bag. However, to date considerable difficulties, both economic and physical, have been encountered in constructing a flat bottom for such a bag.

One known plastic bag employs four diagonal heat seal on the gusset areas. These seals are commonly referred to as chevron seals and are used in addition to the transverse bottom seal. These chevron sealed gusset areas from a portion of the flat bottom when the bag is opened. Unfortunately, very often a flat bottom is only achieved after extra manipulation by the operator. A further drawback to this type of bottom pertains to the length of the bag. Specifically, the bottom extends the length of the bag. The plastic bottom is longer than its paper counterpart. Therefore, conventional plastic bags will not physically fit the existing shelf space. The causes an inconvenience at the stores.

Another existing square bottom plastic bag is constructed by cutting flaps, then folding and gluing these flaps to form a flat bottom. A patch is then glued over the bottom to hold it together. Such bags are usually more expensive than comparable paper bags. Moreover, the flaps create areas on the bottom which are not sealed and allow the bottom to leak. As a result, the major advantage which plastic bags normally enjoy is lost.

Previous methods of constructing flat bottom plastic bags have provided generally unsatisfactory results. Heretofore inadequate and unreliable means have been used for gripping the opposing surfaces of the bag and separating the pleats. As a result of manipulating the bag surfaces, a vacuum is generated within the bag which deforms the intended fold lines. Thus, a generally inferior bottom is formed. Moreover, prior techniques do not permit trapped air to escape from the bottom as it is flattened. Consequently, the bag is liable to burst as pressure is applied during the flattening operation.

During the formation of a single sealed flat bottom plastic bag, one which truly resembles the paper bag, pockets are formed in the pleated sides. These pockets become part of the bottom. Unfortunately, when manufactured in this way, the pockets tend to reopen or separate when objects are placed inside the bag. Therefore, the desired square bottom configuration is lost.

SUMMARY OF THE INVENTION

It is therefore an object of the invention to provide an improved method for quickly, easily and inexpensively manufacturing a flat bottom, substantially freestanding plastic bag.

It is a further object of this invention to provide an improved method for economically constructing flat bottom plastic bags in large quantities from a continuous plastic film.

It is a further object of this invention to provide a flat bottom plastic bag that has a bottom which is more rigid and retains its shape better than the bottoms in previously conceived flat bottom plastic bags.

It is a further object of this invention to provide flat bottom plastic bags that may be effectively used in the fast food and grocery industries and for many other applications.

It is a further object of this invention to provide a method for constructing flat bottom plastic bag which enables trapped air to be expelled during the bottom creasing operation so that bag bursting is reduced.

It is also an object of this invention to provide a method of folding a flat bottom in which the internal vacuum resulting from manipulation of the bag surfaces will not cause deformation of the desired fold lines.

This invention results from a realization that an improved flat bottom plastic bag that does not require gusset seals may be constructed by releasably holding a transverse section of the plastic tube that forms the bag, drawing the bottom of the bag toward the top of the bag, folding the bag along five transverse fold lines and creasing the bag along at least four of those fold lines to define the perimeter of the flat bottom. This invention results from the further realization that a bottom formed in this manner is provided with a higher degree of structural integrity, rigidity and strength by bonding closed the generally triangular pockets formed in the opposing pleated sides of such a bag as the bag is formed. A still further realization is that unintended bursting of the tube or bag during the folding operation may be reduced by employing pressure rollers having circumferential grooves. Such grooves form air channels in the bag that permit trapped air to escape from the bag as pressure is applied.

This invention features a flat bottom plastic bag including a bag member that has an open upper end, a closed lower end formed by a transverse seal, forward and rearward sides, and a pair of opposing pleated sides that interconnect the forward and rearward sides. The forward side includes first and second transverse fold lines and the rearward side includes a third fold line. The pleated sides include fourth and fifth fold lines, respectively, that extend between the first and third fold lines and respective pockets formed between the fourth and fifth fold lines and the lower end of the bag member. The first, third fourth and fifth fold lines are creased to define the perimeter of the flat bottom of the bag. Adhesive means are disposed within the pockets for sealing the pockets closed to increase the rigidity of the flat bottom.

A method for constructing a flat bottom in a plastic bag of this type is also featured by this invention. The method may be practiced on any type of film tube that has a sealed leading end, a trailing portion, forward and rearward sides and a pair of pleated sides. As used herein, "tube" may refer to either a discrete plastic bag having a transversely cut open end in the trailing portion of the tube, or a continuous film tube. The method includes the steps of releasably holding a transverse section of the rearward side of the tube, which section is located above the lower end. The sealed lower end is drawn toward the upper end to fold the tube along first and second transverse fold lines of the forward side, along a third fold line in the transverse section of the rearward side, and along fourth and fifth transverse fold lines, respectively in the pleated sides. In this manner, first and second pockets are formed in the pleated sides between the fourth and fifth fold lines, respectively, and the lower end of the tube. Adhesive is introduced into the first and second pockets and pressure is applied to the folded bag to form creases along the first, third, fourth and fifth fold lines and seal the pockets. Such creases define the perimeter of the flat bottom of the tube.

In a preferred embodiment the transverse section of the tube is releasably held by vacuum means. The sealed end may be drawn by engaging second vacuum means with the forward side of the tube, generally along the first fold line and driving the second vacuum means toward the upper end of the tube. The creasing pressure may be applied by roller means having groove means formed circumferentially therein.

BRIEF DESCRIPTION OF THE DRAWINGS

A particularly preferred embodiment of the bag and method of this invention will be described in detail below in connection with the illustration in which.

DESCRIPTION OF A PREFERRED EMBODIMENT

Figure 1:
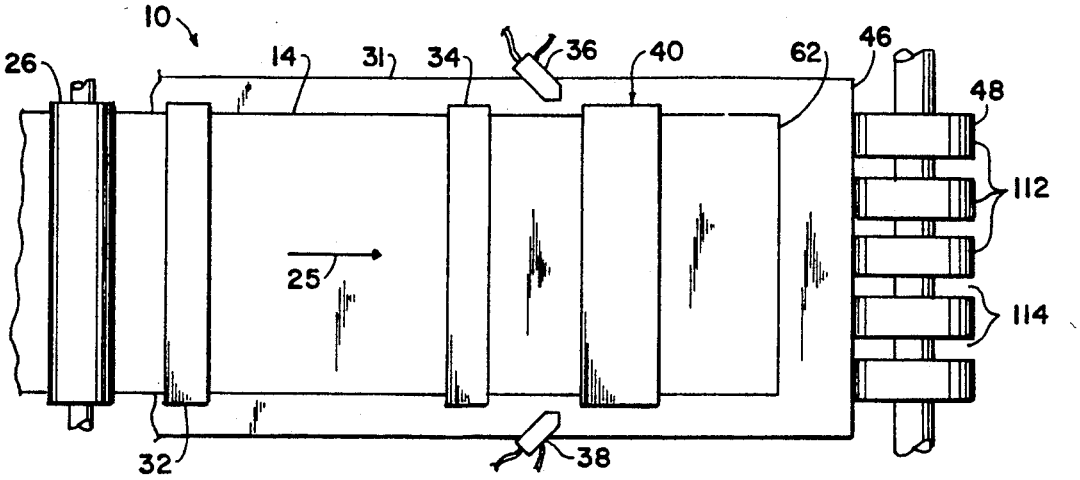
FIG. 1 is a top plan view of an apparatus for constructing flat bottom plastic bags according to the method of this invention.
Figure 2:
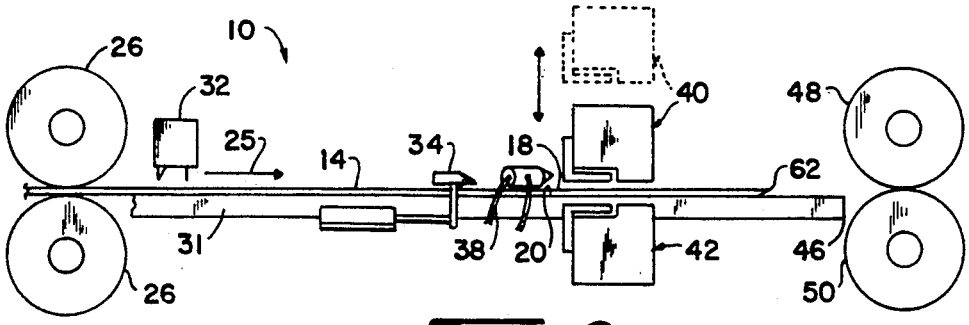
FIG. 2 is an elevational side view of the apparatus of FIG. 1.
Figure 3:
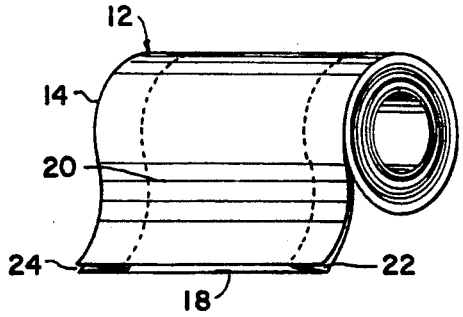
FIG. 3 is an axonometric view of a continuous roll of film tube having pleated sides on which the method of this invention may be practiced.

There is shown in FIGS. 1 and 2 a preferred apparatus 10 for constructing flat bottom plastic bags according to this invention. A continuous roll stock 12 of a preformed plastic film tube 14, shown alone in FIG. 3, is rotatably mounted at one end of apparatus on a conventional roller which is not shown. As illustrated most clearly in FIG. 3, film tube 14 includes a forward side 18, a rearward side 20 and a pair of longitudinally inwardly pleated sides 22 and 24. The film tube is drawn from the roll 12 along a generally planar surface or platform 31, in the direction of arrow 25, FIGS. 1 and 2, utilizing a pair of conventional indexing rollers 26 mounted to platform 31. Tube 14 extends along platform 31 beneath a sealing/cutting mechanism 32, beneath a bag ejection bar 34 and between a pair of adhesive injectors 36 and 38 that are disposed along the longitudinal edges of platform 31. Tube 14 then passes between a pair of upper and lower vacuum and clamp units 40 and 42. Upper vacuum and clamp unit 40 is mounted in a conventional manner to permit vertical and horizontal movement with respect to platform 31 and lower vacuum unit 42 is mounted to platform 31. The leading end of tube 14 terminates at a sealed end 62 proximate the leading end 46 of platform 31. A pair of upper and lower roller devices 48 and 50, FIGS. 1 and 2 are disposed transversely to platform 31 adjacent leading end 46.

Plastic film tube 14 is extruded by a conventional die, not shown, which receives plastic material from a conventional extruder mechanism. The plastic material may be extruded so that certain portions of the formed tube, e.g. pleats 22 and 24, are formed of a thicker gauge material than the remainder of the tube. Air pressure is introduced into the tube after it is emitted by the die. The tube then passes through conventional pleat forming elements, not shown, to form pleated sides 22 and 24. Then, the film may be wound onto continuous roll 12 as shown in FIG. 3 with that roll being supplied to apparatus 10. Alternatively, the film tube may be driven directly from the die onto platform 31 and intermittently through apparatus 10. Film tube 14 may also be formed into individual bags 58, FIG. 4, by transversely cutting the tube at two locations. As a result, upper and lower ends 60 and 62 are provided. Upper end 60 is left open and lower end 62 is closed. This cutting and sealing is performed by mechanism 32 as described below.

Figure 4:
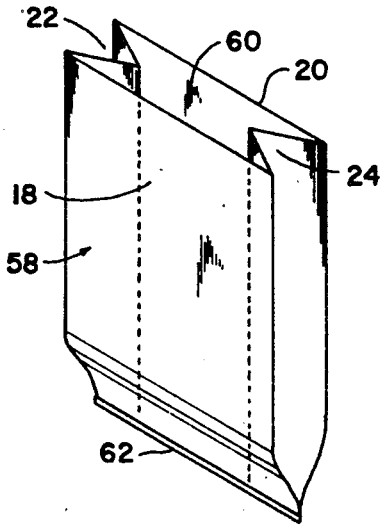
FIG. 4 is an axonometric view of a plastic bag having a pair of opposing pleated sides and a heat sealed lower end on which the method of this invention may be practiced.

It should be understood that the method of this invention may be utilized with equal effectiveness both with bag 58 of FIG. 4 and with continuous film tube 14, FIG. 3, to construct a flat bottom plastic bag. Referring specifically to the latter embodiment, the method proceeds as follows.

Figure 10:
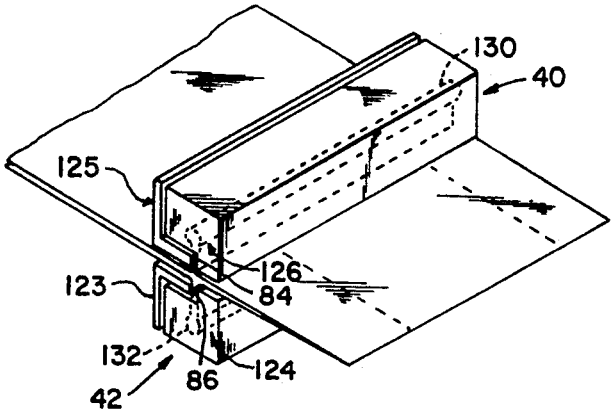
FIG. 10 is an isometric view of the upper and lower vacuum and clamp units.
Figure 11:
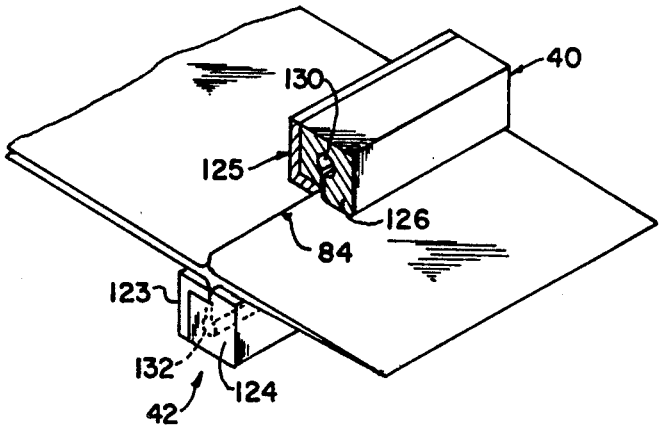
FIG. 11 is an isometric, partly sectional view of the vacuum and clamp units in operation.

With film tube 14 positioned as shown in FIGS. 1 and 2, the vacuum portion of the vacuum and clamp units 40 and 42 are activated. The vacuum 132 of the lower unit 42 contacts the rearward side of tube 14 and causes a complete transverse section of film, which corresponds to fold line 86 of FIG. 9, to be drawn between the clamping elements 123 and 124 of unit 42. L-shaped element 123, FIG. 10, is then activated closed against an edge of member 124. This releasably holds and creases fold line 86, as shown in FIG. 11. Simultaneously, the vacuum and clamp unit 40 is lowered by standard mechanical means so that the face of unit 40 contacts the forward side of tube 14. The vacuum 130 of unit 40 causes a complete transverse section of film, which corresponds to fold line 84 of FIG. 9, to be drawn between the clamping elements 125 and 126 of unit 40. These elements are then activated closed, thus releasably holding and creasing fold line 84, as shown in FIG. 11. After the clamping portions of units 40 and 42 are closed the vacuum may be deactivated.

It should be noted that the clamp elements 123, 124 and 125, 126 can be of standard mechanical construction known to those skilled in the art. Alternatively, once the fold lines 84 and 86 are drawn into the area shown in FIG. 10, they can be retained by electrostatic means. The preferred method will depend on the stiffness or thickness of the thermoplastic material upon which the folding process is being performed. Referring specifically to the clamping embodiment, the method proceeds as follows.

Figure 5:
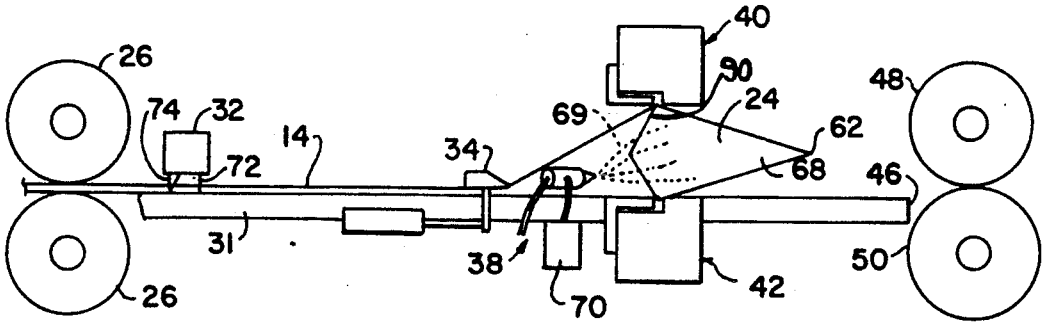
FIG. 5 is an elevational side view of the apparatus of FIGS. 1 and 2 showing the separation of the pleats and the introduction of adhesive into the pockets.

With the complete transverse fold lines 84 and 86 securely held, vacuum/clamp unit 40 is then raised by a conventional mechanical structure to the position shown in phantom and also shown in FIG. 5. This opens the pleated sides 22 and 24 as shown in FIG. 5. More specifically, a generally triangular pocket 68 is formed in each of the pleated sides proximate the sealed leading end 62 of bag 14. Adhesive injectors 36 and 38 are then activated so that adhesive 69 supplied by reservoir 70 is sprayed into each of the pockets 68. The adhesive injectors may comprise atomizers or other conventional sprayer devices. Adhesive 69 may include any conventional adhesive suitable for use on plastic bags.

At the same time that the adhesive 69 is being injected into the respective pockets 68, the sealing/cutting mechanism 32 is lowered so that tube 14 is transversely cut by a blade 72. This cut forms the open upper end 60 of the bag that is being formed. At the same time, a heat sealing element 74 engages the leading end of the following section of tube so that a sealed leading end 62 is formed for the subsequent bag. After this operation is completed, mechanism 32 is raised as shown in FIG. 6.

Figure 6:
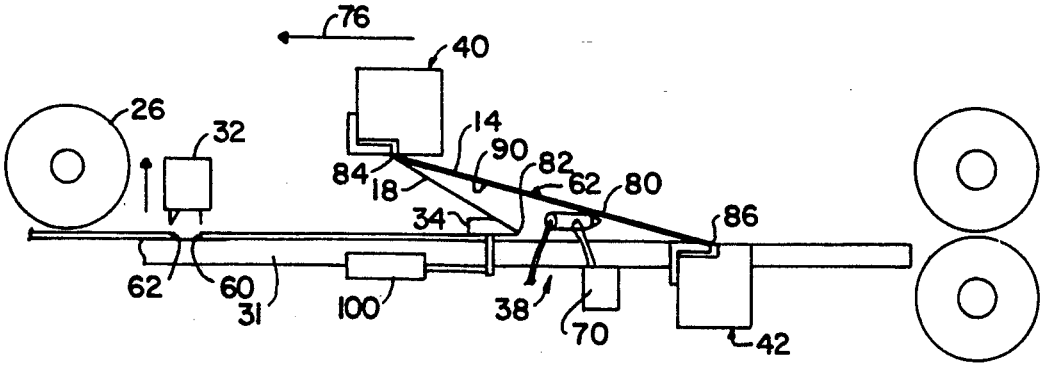
FIG. 6 is an elevational, side view similar to FIG. 5 of the apparatus drawing the lower end of the continuous tube rearwardly to form the fold lines.

As further depicted in FIG. 6, vacuum and clamp unit 40 is then driven by conventional mechanical structure to reciprocate in the direction of arrow 76 toward the trailing upper end 60 of tube 14 so that a bottom surface portion 80 of tube 14 is drawn toward trailing upper end 60. In particular, heat sealed leading end 62 is drawn toward trailing end 60. This motion is continued until the forward side 18 of tube 14 folds against the transverse bag ejection bar 34. As a result, a first fold line 82 is formed transversely in forward side 18 and a second fold line 84 is similarly formed transversely across forward side 18 generally along the line gripped by upper vacuum and clamp unit 40. At the same time, vacuum and clamp unit 42 continues to grip the transverse section of rearward side 20 so that a third fold line 86 is created above the lower vacuum 42. This drawing and folding action likewise creates a pair of fold lines 88 and 90, best shown in FIG. 8, in the pleated sides 22 and 24, respectively. Each of the fold lines 88 and 90 in the pleated sides extends between respective ends of the transverse fold lines 84 and 86 in the forward and rearward sides. Each pleated side also includes a bottom edge 94, FIGS. 8 and 9, that interconnects one end of fold line 84 with one end of fold line 86. Each pocket 68 containing adhesive 69 is formed between a respective fold line 88, 90 and a respective lower edge 94.

Figure 7:
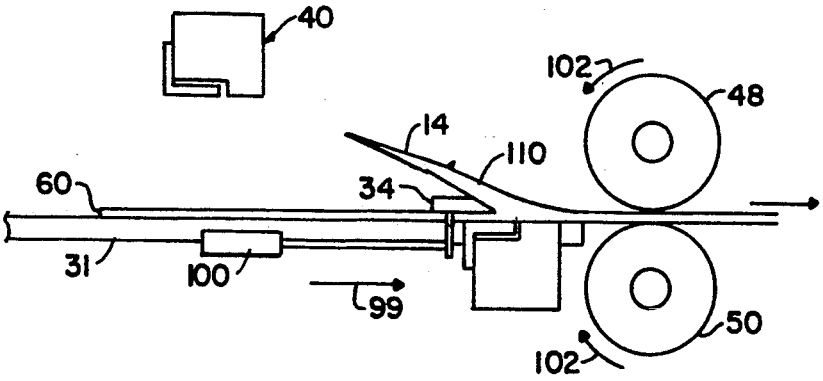
FIG. 7 is an elevational side view of the folded bag or film being passes between a pair of rollers to form creases along the fold lines.

As shown in FIG. 7, after the folds have been formed, units 40 and 42 release tube 14. Bag ejection bar 34 is then driven forward in the direction of arrow 99 by one or more actuating cylinder mechanisms 100. This indexes tube 14 in the direction of arrow 99 so that tube 14 is driven between roller devices 48 and 50. The roller mechanisms are driven in the direction of arrows 102 so that tube 14 is driven completely through the rollers. These rollers are operated by belts, chains or other drive mechanisms known to those skilled in the art so that they apply pressure to tube 14; such pressure adds permanence to fold lines 82, 84 and 86 as well as the obscured transverse fold lines 88 and 90 in the pleated sides. This closes the pockets 68 in the pleated sides and the adhesive seals those pockets in that closed condition. As a result, a relatively rigid flat bottom 110 is formed and the bag is completed.

As best shown in FIG. 1 each of the roller devices 48 and 50 comprises a plurality of roller elements 112 having circumferential grooves 114 formed between each of the adjacent elements 112. These grooved rollers help to reduce unintended bursting of the flat bottom 110. As the bottom portion 110 proceeds through the rollers, air that is trapped within the folded bottom portion 110 is permitted to escape through the tube and, more particularly, through the channels that are formed in the tube by the grooves 114. The trapped air is released through these channels and out the upper end 60 of the tube.

Once the folded tube has been engaged by roller devices 48 and 50, the bag ejection bar 34 is retracted by its cylinders 100 to the position shown in FIG. 1. Similarly, upper vacuum unit 40 is returned to the position shown in phantom of FIG. 1 so that it may be subsequently lowered to engage a subsequent tube segment on the platform 31. The method may then be repeated on subsequent sections of tube that are moved into place by roller 26.

Figure 8:
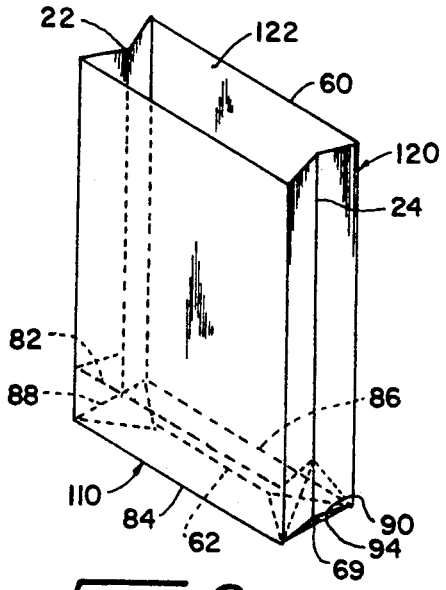
FIG. 8 is an axonometric view of a free standing, flat bottom plastic bag formed according to the method of this invention.
Figure 9:
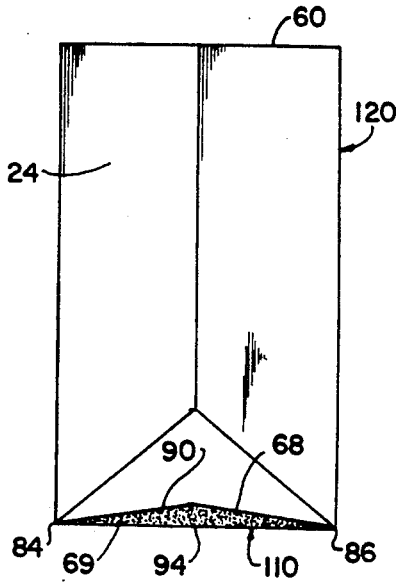
FIG. 9 is a side elevational view of the bag of FIG. 8.

Each tube 14 that is folded, creased and cut in the above described manner may be opened to form a flat bottom free standing plastic bag 120, as shown in FIGS. 8 and 9. Cut end 60 opens up to form an opening 122. Transverse fold lines 84 and 86 define two sides of the perimeter of flat bottom 110 and transverse fold lines 88 and 90 along with respective edges 94 define the remaining two opposing sides of the perimeter of the bottom surface of bag 120.

Due to adhesive 69, fold lines 88 and 90 are held in substantial conformance with lower edges 94, FIGS. 8 and 9 so that the pockets 68 are virtually closed. The width of the pockets 68 is exaggerated in FIGS. 8 and 9 for clarity so that the adhesive may be illustrated. In actuality, the pocket is closed such that each transverse fold line 88, 90 is virtually coextensive with a lower edge 94. This provides for improved rigidity of the flat bottom 110. As a result, with the bag fully open, flat bottom 110 stably and firmly supports the bag so that it will not tip and so that items may be conveniently inserted into and removed from the bag without deforming the flat bottom 110. Without such adhesive, the pockets 68 tend to open when heavy items are placed inside or while the bag is initially opened. This may cause the bottom surface of the bag to lose its rigidity and shape. Applicants provision of adhesive substantially reduces this problem and allows the bag to better retain its flat bottom. Moreover, flat bottom 110 is constructed without requiring any gusset seals or cut and glued flaps and patch, thereby greatly improving the resistance to leakage and decreasing the length of the bag. If desired, the bag may be formed with a thicker gauge plastic forming portions of the sides to provide even further stiffness to the opened, upright bag.

From the forgoing it may be seen that a method of this invention provides for the construction of a simple and inexpensive and yet very effective flat bottom plastic bag which is both free standing and tear and leak resistent. At the same time, this technique eliminates the need for multiple gusset heat seals or lapped adhesive seals. The apparatus discloses only one example of an apparatus which may be used to practice the method of this invention. This invention is not limited to the illustrated apparatus and may be practiced on various alternative apparatuses. Although the specific features of this invention are shown in some drawings and not in others, this is for convenience only as each feature may be combined with any or all of the other features in accordance with the invention.

Other embodiments will occur to those skilled in the art and are within the following claims.

What is claimed is:

1. A method of constructing a flat bottom in a plastic film tube having an open upper end, a closed lower end formed by a transverse seal, forward and rearward sides and a pair of opposing pleated sides that interconnect the forward and rearward sides comprising the steps of:

releasably engaging first a lower vacuum and then a lower clamp with a transverse section of said rearward side of the tube to provisionally hold said transverse section;

gripping a lateral section of said forward side with first an upper vacuum and then an upper clamp and raising said lateral section to expose a portion of said pleated sides such that first and second pockets are formed, respectively, in the said sides;

drawing said sealed lower end toward said upper end to fold the tube along first and second transverse fold lines in the forward side, along a third transverse fold line in said transverse section of said rearward side, and along fourth and fifth fold lines, respectively, in said pleated sides such that said first and second pockets are located in said pleated sides, respectively between said first and third fold lines and the lower end of said tube; and applying pressure to the tube to form creases along said first, third, fourth and fifth fold lines, whereby the creases define the perimeter of the flat bottom of the tube.

2. A method of constructing a flat bottom in a plastic film tube having an open upper end, a closed lower end formed by a transverse seal, forward and rearward sides and a pair of opposing pleated sides that interconnect the forward and rearward sides comprising the steps of:

releasably engaging first a lower vacuum and then a lower clamp with a transverse section of said rearward side of the tube to provisionally hold said transverse section;

gripping a lateral section of said forward side with first an upper vacuum and then an upper clamp and raising said lateral section to expose a portion of said pleated sides such that first and second pockets are formed, respectively, in the said sides;

drawing said sealed lower end toward said upper end to fold the tube along first and second transverse fold lines in the forward side, along a third transverse fold line in said transverse section of said rearward side, and along fourth and fifth fold lines, respectively, in said pleated sides such that said first and second pockets are located in said pleated sides, respectively between said first and third fold lines and the lower end of said tube; and applying pressure to the tube in a series of parallel spaced apart strips that extend longitudinally from said upper end to said lower end of said tube to discharge air from said tube through channels formed between said strips and to form creases along said first, third, fourth and fifth fold lines, whereby the creases define the perimeter of the flat bottom of the tube.

3. A method of constructing a flat bottom in a plastic film tube having an open upper end, a closed lower end formed by a transverse seal, forward and rearward sides and a pair of opposing pleated sides that interconnect the forward and rearward sides comprising the steps of:

releasably engaging first a lower vacuum and then a lower clamp with a transverse section of said rearward side of the tube to provisionally hold said transverse section;

gripping a lateral section of said forward side with first an upper vacuum and then an upper clamp and raising said lateral section to expose a portion of said pleated sides such that first and second pockets are formed, respectively, in the said sides;

introducing adhesive into said first and second pockets;

drawing said sealed lower end toward said upper end to fold the tube along first and second transverse fold lines in the forward side, along a third transverse fold line in said transverse section of said rearward side, and along fourth and fifth fold lines, respectively, in said pleated sides such that said first and second pockets are located in said pleated sides, respectively between said first and third fold lines and the lower end of said tube; and applying pressure to the tube to in a series of parallel spaced apart strips that extend longitudinally from said upper end to said lower end of said tube to discharge air from said tube through channels formed between said strips and to form creases along said first, third, fourth and fifth fold lines, whereby the creases define the perimeter of the flat bottom of the tube.

4. The method of claim 1 further including clamping said transverse section with said lower clamp along generally the entire width of said rearward side and clamping said lateral section with said upper clamp along generally the entire width of said forward side.

* * * * *